United States Patent [19]

Hashiguchi et al.

[11] Patent Number: 4,830,686

[45] Date of Patent: May 16, 1989

[54] LOW YIELD RATIO HIGH-STRENGTH ANNEALED STEEL SHEET HAVING GOOD DUCTILITY AND RESISTANCE TO SECONDARY COLD-WORK EMBRITTLEMENT

[75] Inventors: Koichi Hashiguchi; Akio Tosaka; Toshio Irie, all of Chiba; Isao Takahashi, Kurashiki, all of Japan

[73] Assignee: Kawasaki Steel Corporation, Kobe, Japan

[21] Appl. No.: 41,788

[22] Filed: Apr. 22, 1987

Related U.S. Application Data

[62] Division of Ser. No. 606,836, Apr. 12, 1984, abandoned.

[51] Int. Cl.[4] ..... C22C 38/04

[52] U.S. Cl. ..... 148/320; 148/330; 148/333; 148/334

[58] Field of Search ..... 148/334, 333, 337, 320, 148/330, 12 F, 12.1, 12.4; 420/87

[56] References Cited

U.S. PATENT DOCUMENTS 4,314,862 2/1982 Sudo et al. ..... 148/12 F

FOREIGN PATENT DOCUMENTS 57-131325 8/1982 Japan ..... 148/12 F

*Primary Examiner*—Deborah Yee

*Attorney, Agent, or Firm*—Balogh, Osann, Kramer, Dvorak, Genova & Traub

[57] ABSTRACT

The invention relates to a method of manufacturing a high-strength steel sheet by annealing the steel sheet after cold rolling. In order to obtain the low-yield ratio, high-strength steel sheet having high strength and good ductility, resistance to secondary cold-work embrittlement and spot weldability at low cost, the steel sheet containing 0.03–0.15% of P and specified amounts of C, Mn and Al as basic components and optionally containing, as a selective component, at least one element selected from a group of Si, Cr, Mo and B and a group of Nb, Ti, and V in such amounts as to meet the relation formula restricting the total content of Mn, Si, P, Cr and Mo is subjected to annealing under the conditions that the sheet is heated at a temperature of from $Ac_1$ transformation point to 950° C. for from 10 seconds to 10 minutes and cooled in such a control manner that an average cooling rate between 600° C. and 300° C. is not less than a specified critical cooling rate CR pertaining to the chemical composition and within a range of 15°–200° C./sec (FIGS. 1 and 4). The invention is suitable for the production of bumper, door guard bar, and the like in the automotive vehicles.

8 Claims, 4 Drawing Sheets

LOW YIELD RATIO HIGH-STRENGTH ANNEALED STEEL SHEET HAVING GOOD DUCTILITY AND RESISTANCE TO SECONDARY COLD-WORK EMBRITTLEMENT

This is a division of application Ser. No. 606,836, filed Apr. 12, 1984, now abandoned.

TECHNICAL FIELD

This invention relates to a method of manufacturing a low-yield ratio, high-strength steel sheet having good ductility, resistance to secondary cold-work embrittlement, spot weldability and the like through annealing after cold rolling, and more particularly to a method of cheaply manufacturing a high-strength steel sheet having a tensile strength of not less than 50 kg/mm$^2$.

BACKGROUND TECHNIQUE

Recently, there have frequently been used high-strength steel sheets having a tensile strength of not less than 50 kg/mm$^2$ in high-strength members such as bumper, door guard bar and the like from the standpoints of the safety and the weight-saving of automotive vehicles. The materials for use in these applications are required to have the properties that the tensile strength is high, and the ductility is good, while the spot weldability as well as the resistance to secondary cold-work embrittlement are good at or after the assembling of the vehicle body. Lately, there have been used steel sheets having a dual-phase structure composed of ferrite and a low temperature transformation product consisting mainly of martensite as a steel sheet satisfying the above requirements. However, in order to increase the strength in such conventional dual-phase structure steel sheets, it is necessary to add alloying elements such as Mn, Si, Nb, Ti and the like in large quantities and consequently the production cost increases. Further, the addition of a large amount of Mn, Si or the like is apt to cause surface oxidation during the continuous annealing, resulting in the deterioration of the spot weldability and the resistance to secondary cold-work embrittlement. Therefore, it is difficult to cheaply manufacture a high-strength steel sheet having excellent ductility, spot weldability and resistance to secondary cold-work embrittlement up to now.

It is an object of the invention to eliminate the above problems of the prior art, and to provide a method of manufacturing a low yield ratio, highstrength steel sheet which is cheap in the production cost and has good ductility, resistance to secondary cold-work embrittlement, spot weldability and the like.

DISCLOSURE OF THE INVENTION

In order to achieve the above object, the invention is to manufacture a low yield ratio high strength steel sheet having good ductility, spot weldability and the like, in which the deterioration of the resistance to secondary cold-work embrittlement due to addition of P is suppressed by performing an annealing treatment under controlled heating and cooling conditions after the cold rolling of a steel sheet with a chemical composition adjusted by positive addition of P, which has extremely been restricted in use owing to the promotion of brittleness, as a cheap strengthening element.

That is, the invention lies in a method of manufacturing a low-yield ratio, high-strength steel sheet having good ductility and resistance to secondary cold-work embrittlement, characterized in that a steel sheet comprising as a weight percentage 0.02–0.15% of C, 0.2–3.5% of Mn (provided that the lower limit is set at 0.8% in case of no addition of Si, Cr, Mo and B), 0.03%–0.15% of P and not more than 0.10% of Al as basic components, and optionally containing, as a selective component, at least one element selected from group-A consisting of 0.1–1.5% of Si, 0.1–1.0% of Cr, 0.1–1.0% of Mo and 5–100 ppm of B, and group-B consisting of 0.01–0.1% of Nb, 0.01–0.2% of Ti and 0.01–0.2% of V, provided that the amount of the selective components added satisfies the following formula:

$$\text{Mn}\,\% + 0.26\text{Si}\,\% + 3.5\text{P}\,\% + 1.3\text{Cr}\,\% + 2.67\text{Mo}\,\% \geqq 0.64\%$$

and the balance being Fe with inevitable impurities, is subjected to an annealing treatment comprising the steps of:

heating the steel sheet at a temperature of from $Ac_1$ transformation point to 950° C. for from 10 seconds to 10 minutes; and cooling the thus treated sheet under such a condition that an average cooling rate between 600° C. and 300° C. after the heating is not less than a critical cooling rate CR(° C./sec) calculated by the following formula:

$$\log \text{CR}(^\circ\text{C./sec}) = -1.73[\text{Mn}\% + 0.26\text{Si}\% + 3.5\text{P}\% + 1.3\text{Cr}\% + 2.67\text{Mo}\%] + 3.95$$

provided that the value of 3.95 is changed into 3.40 in case of addition of B and is within a range of 15°–200° C./sec.

BEST MODE FOR CARRYING OUT THE INVENTION

The invention will be described in more detail below.

As the method of manufacturing high-strength cold rolled steel sheets using P, there are techniques disclosed in Japanese Patent laid open No. 50-23,316 and No. 50-60,419. According to the method of Japanese Patent laid open No. 50-23,316, a high-yield point steel sheet is obtained by the continuous annealing and overaging treatment and is a solid-solution strengthened steel composed of ferrite and carbide, which is different from the method of the invention in that no overaging is performed after the continuous annealing.

In Japanese Patent laid open No. 50-60,419, the manufacturing conditions, particularly the cooling rate during the continuous annealing is smaller, so that the resulting structure is a dual phase consisting of a ferrite phase and a large amount of visible carbides uniformly located in ferrite phase. Therefore, this structure is quite different from the dual-phase structure according to the invention composed of a low temperature transformation product mainly consisting of ferrite phase and martensite phase, and a residual austenite phase.

The above acknowledgement has been obtained by the inventors based on the following experiments which will be explained.

TABLE 1

| Steel | Classification | Chemical composition (% by weight) C | Si | Mn | P | Al | CR °C./sec |
|---|---|---|---|---|---|---|---|
| A | Comparative steel | 0.050 | 0.010 | 1.52 | 0.010 | 0.032 | 18.2 |
| B | Invention steel | 0.053 | 0.011 | 1.52 | 0.045 | 0.029 | 11.2 |
| C | Invention steel | 0.056 | 0.026 | 1.51 | 0.10 | 0.030 | 5.4 |
| D | Invention steel | 0.051 | 0.032 | 1.52 | 0.14 | 0.029 | 3.0 |
| E | Comparative steel | 0.051 | 0.032 | 1.52 | 0.20 | 0.029 | 1.3 |

Figure 1:
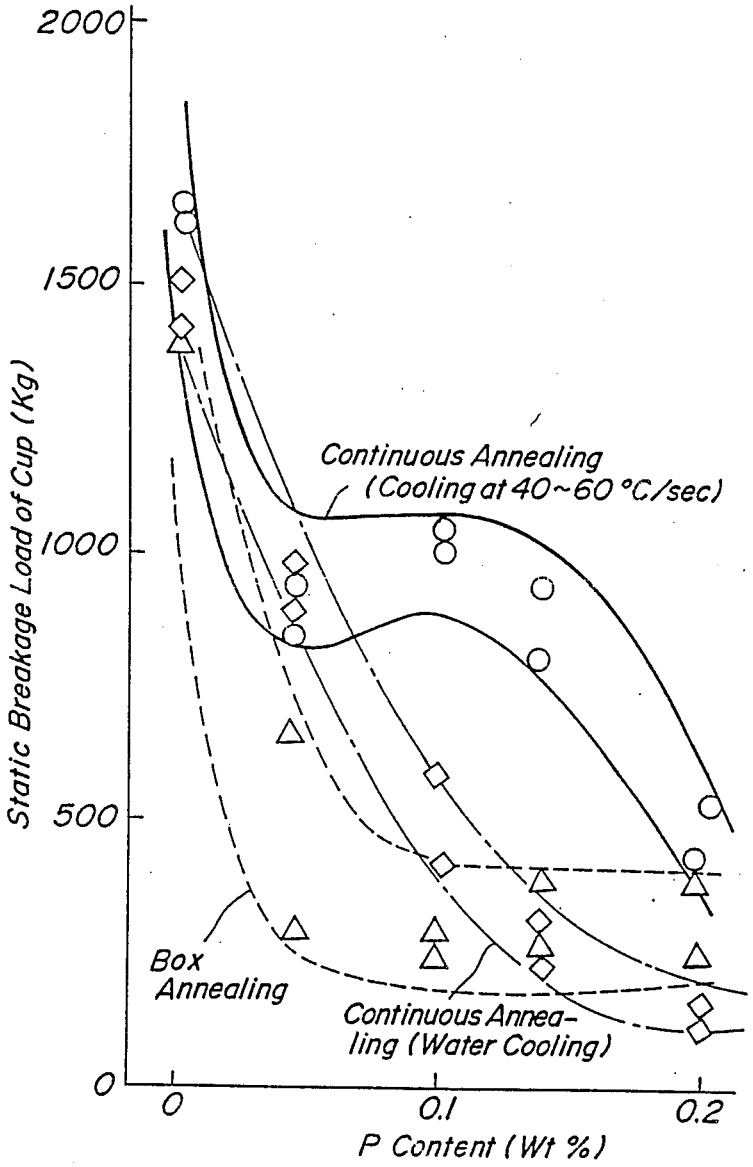
FIG. 1 is a graph showing influences of P content and annealing conditions upon the resistance to secondary cold-work embrittlement.
Figure 2:
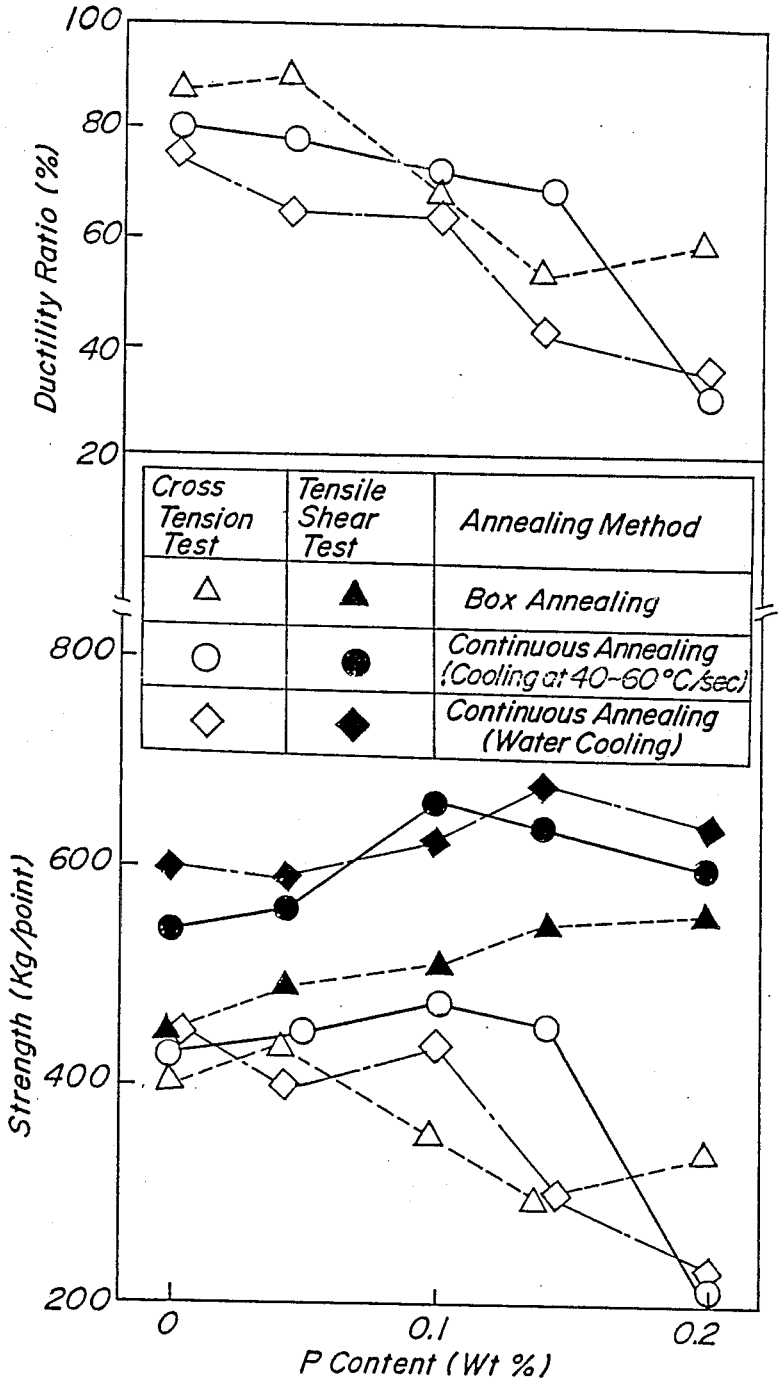
FIG. 2 is a graph showing influences of P content and annealing conditions upon the spot weldability.
Figure 3:
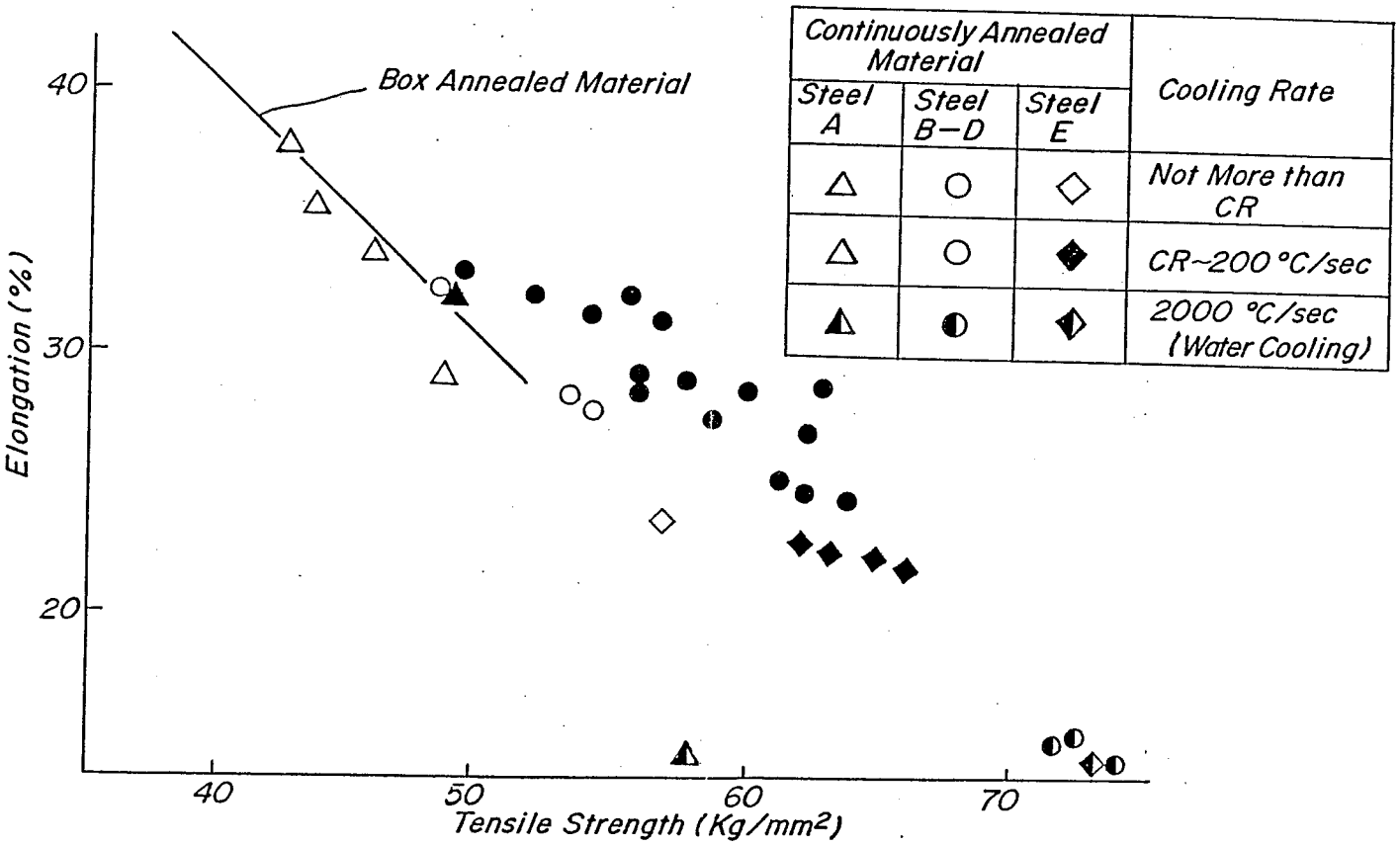
FIG. 3 is a graph showing influences of P content and annealing conditions upon the relation between tensile strength and elongation.

A cold rolled steel sheet with a thickness of 0.8 mm having a varied P content in the chemical composition shown in Table 1 was subjected to three different annealing treatments, i.e. the conventional box annealing at 670° C. for 10 hours, the annealing according to the invention in which a gas jet cooling was conducted at an average cooling rate of 40°-60° C./sec between 600° C. and 300° C. after the heating at 770° C. for 60 seconds, and the comparative water-cooled annealing at a cooling rate of about 2,000° C./sec. The resistance to secondary cold-work embrittlement represented by the static breakage load of cup, spot weldability represented by the strength and ductility ratio of welded joint, and the relation between tensile strength and elongation were measured with respect to the above treated steel sheet to obtain results as shown in FIGS. 1, 2 and 3. As seen from FIG. 1, the resistance to secondary cold-work brittlement is deteriorated with the increase of the P content in any of the above annealing conditions. However, the continuously annealed steel sheet according to the invention method, which was subjected to the gas jet cooling, is small in the degree of deterioration and has a static breakage load of not less than 800 kg when the P content is not more than 0.15%, which exhibits the satisfactory resistance to secondary cold-work embrittlement in practical use. The steel sheets according to the invention also exhibit the good results with respect to the spot weldability, tensile strength, and elongation (FIGS. 2 and 3).

The reason for the limitation on the chemical composition of the steel sheet according to the invention will be explained below.

C

C is an important element as one of the basic components in steel. Particularly, according to the invention, since the volume fraction of $\gamma$-phase at the soaking temperature in an $\alpha$-$\gamma$ region is mainly determined by the C content in steel and the heating temperature and further the C content in steel influences the amount of martensite after cooling, C is important. The reason why the upper and lower limits are imposed on the C content is due to the followings. Even if it is less than 0.02%, the dual-phase structure aimed at the invention can be fundamentally obtained, but $Ac_1$ point steeply rises to make narrower a temperature range for $\alpha$-$\gamma$ dual phase region and consequently it is very difficult to control the temperature during the annealing. Thus, the lower limit is set at 0.02%. On the other hand, the increase of the C content is preferable to increase the strength and improve the resistance to secondary cold-work embrittlement, but if it exceeds 0.15%, the spot weldability rapidly deteriorates. Thus, the upper limit is set at 0.15%.

Mn

Mn is a solid-solution strengthening element and is necessary to secure the strength. According to the invention, Mn is particularly an important element for the formation of the low temperature transformation product together with P. The lower limit of Mn is determined to meet the requirement that the critical cooling rate CR of the following equation (1) is not more than 200° C./sec:

$$\log CR(°C./sec) = -1.73\,[Mn\,\% + 0.26\,Si\,\% + 3.5\,P\,\% + 1.3\,Cr\,\% + 2.67\,Mo\,\%] + 3.95 \quad (1)$$

provided that the value of 3.95 is changed into 3.40 in case of addition of B. That is, when none of Si, Cr, Mo, B are contained, the value CR of the equation (1) becomes not less than 200° C./sec if Mn is less than 0.8%, and therefore, the lower limit is set at 0.8%. When at least one of Si, Cr, Mo and B is contained, it is possible to reduce the Mn content because these elements serve to reduce the value CR. However, the lower limit is set at 0.2% from the standpoint of the melting, and it is necessary to meet the following requirement in order that the value CR of the formula (1) is not more than 200° C./sec:

$$Mn\% + 0.26Si\% + 3.5P\% + 1.3Cr\% + 2.67Mo\% \geqq 0.64$$

On the other hand, the value CR decreases with the increase of the Mn content, and the intended dual-phase structure steel can be obtained even at a relatively low cooling rate. But, if the Mn content exceeds 3.5%, the spot weldability is deteriorated likewise the case with C. Thus, the upper limit is set at 3.5%.

P

P is a cheap ferrite-forming element having a large solid-solution strengthening ability, but has the defect of promoting the brittleness, so that the use of P has been restricted up to now. The inventors have obtained the acknowledgement different from the conventional ones based on the detailed experiments.

That is, as shown in the formula (1), the lower limit of the cooling rate giving the dual-phase structure, i.e., the critical cooling rate CR decreases as the amount of P increases. Thus, P has the effect of stabilizing $\gamma$-phase likewise Mn. As shown in FIG. 1, when the heating conditions are controlled to particular ones, the degree of deterioration in the static breakage load of a cup at the liquid $N_2$ temperature representing the resistance to secondary cold-work embrittlement is smaller if P is not more than 0.15%. As shown in FIG. 2, the degree of deterioration in the strength and the ductility ratio of welded joint representing the spot weldability is small when P is not more than 0.15%, but if P exceeds 0.15%, the above properties rapidly degrade. From the above results, the upper limit of P is set at 0.15%. On the other hand, since at least 0.03% of P is necessary for the formation of the dual-phase structure, the lower limit of P is set at 0.03%.

Al

Al is necessary as a deoxidizing element, but an excess amount of Al forms alumina cluster to deteriorate the surface properties and increase the danger of producing hot crack. Therefore, the upper limit is set at 0.10%.

The basic components of the high-strength steel sheet according to the invention are constituted by C, Mn, P and Al in the respective limited amounts. Further the object of the invention can be more effectively achieved by a high-strength steel sheet further containing at least one element selected from elements of Si, Cr, Mo and B as group-A and elements of Nb, Ti and V as group-B in the respective amount as limited below. The reason for the limitation on these elements is as follows in.

Group A (Si, Cr, Mo, B)

As obvious from the equation (1), all elements of the group-A have the effects of decreasing the critical cooling rate required for the formation of the dual-phase structure and at the same time increasing the amount of the low temperature transformation product and hence increasing the strength. In order to exhibit these effects, not less than 0.1% of each of Si, Cr, Mo and not less than 5 ppm of B are necessary. On the other hand, since excess addition of these elements saturates the effect and increases the cost, Si is limited to not more than 1.5%, Cr and Mo are limited to not more than 1.0%, respectively, and B is limited to not more than 100 ppm. As regards CR, the group-A should satisfy the following requirement from the reason as previously mentioned:

$$Mn\% + 0.26Si\% + 3.5P\% + 1.3Cr\% + 2.6\text{-}7Mo\% \geqq 0.64\%$$

Group B (Nb, Ti, V)

Each of Nb, Ti and V is a carbonitride forming element and has an effect of increasing the strength by fine grain formation and the restraint of the recrystallization of ferrite phase. However, since each of these elements does not fully exhibit the above effect if it is less than 0.01%, the lower limit thereof is set at 0.01%. Since the excess addition causes the saturation of the effect and the increase of cost, Nb is limited to not more than 0.1%, and Ti and V are limited to not more than 0.2%, respectively.

Although each element in the groups-A and -B exhibits the above effects when used alone, the effects imparted by these elements are not offset in the case of the combined addition.

The dual-phase structure, low-yield ratio, high-strength steel sheet having good ductility, resistance to secondary cold-work embrittlement and spot weldability can be manufactured at low cost by controlling the heat treating conditions of the steel sheet having the above defined chemical composition as mentioned later.

The steel within the scope of the invention is subjected to hot rolling, pickling, cold rolling and continuous annealing. The hot rolling is carried out under the usual conditions, but the coiling is preferable to be performed at a low temperature of not more than 600° C. in order to obtain a high strength.

Now, the reason for the limitation on the annealing conditions in the invention will be explained.

The annealing conditions are most important requirements in the invention. At first, the heating temperature must be not less than $Ac_1$ point in order to obtain austenite phase as a matrix for low temperature transformation product phase. When the heating temperature is more than $Ac_1$ point, the amount of $\gamma$-phase increases with the increase in the temperature, and consequently the amount of the low temperature transformation product after the cooling increases. For this reason, the high temperature annealing is preferable in order to obtain a higher strength. However, when the heating temperature exceeds 950° C., the increase of the strength is saturated and at the same time the temper color and pick-up occur, so that the upper limit is set at 950° C. The term "pick-up" used herein means the phenomenon that the oxidized scale fallen from the preceding steel sheet attaches to the trailing steel sheet in the continuous annealing line or the like. On the other hand, since the high strength is obtained at a low temperature side of the $\alpha$-$\gamma$ region when the element of Nb, Ti, V or the like is added, it is preferable to carry out the low temperature annealing at the $\alpha$-$\gamma$ region.

As to the heating time, it is necessary to hold the steel sheet for at least 10 seconds for producing the predetermined amount of $\gamma$-phase. When the steel sheet is held for more than 10 minutes, it is necessary to make the soaking zone of an annealing furnace longer or to reduce the line speed of the steel sheet, resulting in the increase of the cost. Thus, the upper limit is set at 10 minutes.

Since the cooling from the heating temperature largely influences the resistance to secondary cold-work embrittlement, it is most important. Although it is not clear that the steel according to the invention is excellent in the ductility, spot weldability, and particularly the resistance to secondary cold-work embrittlement as compared with the conventional common knowledge, the range of the cooling rate is determined as conditions for obtaining the high strength and the above three good properties. First, as shown in FIG. 3, the relation between strength and ductility is good in the dual-phase structure steel sheet after the cooling at a rate of not less than CR calculated from the equation (1). As apparent from FIG. 1, the resistance to secondary cold-work embrittlement is conspicuously deteriorated in case of the box-annealed steel, i.e., the ferrite carbide steel after the cooling at a low cooling rate, but is excellent in case of the dual-phase structure steel sheet after the cooling at the cooling rate of not less than CR.

Figure 4:
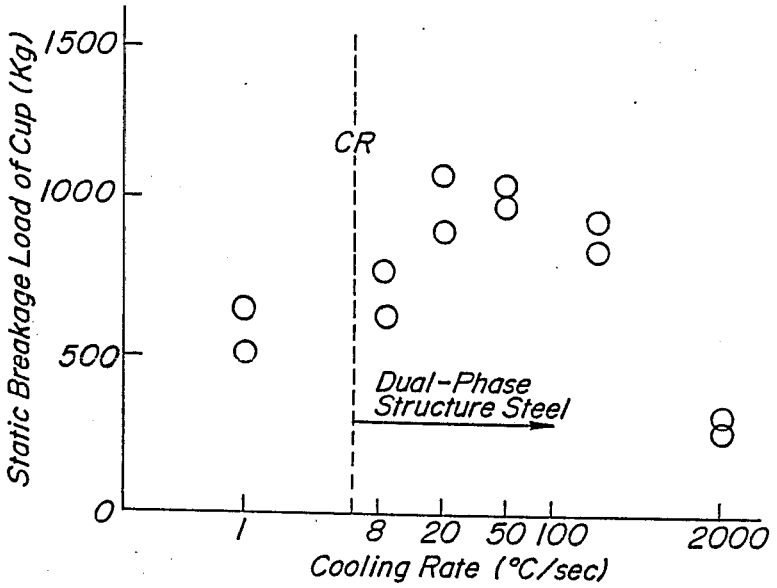
FIG. 4 is a graph showing a relation between the resistance to secondary cold-work embrittlement and the cooling rate in annealing.

Further, FIG. 4 shows the influence of the cooling rate on the resistance to secondary cold-work embrittlement with respect to Steel C (invention steel) in Table 1, in which the value CR for the steel C is about 5° C./sec. The dual-phase structure is obtained even by air-cooling at a cooling rate of 8° C./sec, but the resistance to secondary cold-work embrittlement or the static breakage load of cup does not reach the practical limit value of 800 kg. That is, if the cooling rate is less than 15° C./sec, the resistance to secondary cold-work embrittlement is not improved though the dual-phase structure is obtained. The tensile strength of the dual-phase structure steel sheet increases as the cooling rate becomes higher, so that in order to obtain a higher strength at the same chemical composition, higher cooling rate is preferable. From the above reasons, the cooling rate is restricted to not less than the value CR calculated from the equation (1) and to not less than 15° C./sec.

If the cooling rate is not less than the value CR, the dual-phase structure can be obtained at any cooling rate. However, as shown in FIG. 1, the resistance to secondary cold-work embrittlement is deteriorated in case of an extremely high cooling rate, for instance, in case of water-cooling. Therefore, the upper limit of the cooling rate is set at an intermediate cooling rate of 200°

C./sec between the gas jet cooling and the water cooling. Moreover, the aforementioned cooling rate is an average cooling rate between 600° C. and 300° C. It is necessary to reduce the C content solid-soluted in ferrite in order to improve the ductility or reduce the yield stress. For this purpose, it is preferable to conduct a slow cooling at a cooling rate of not more than 20° C./sec at a high temperature range of not less than 600° C.

As mentioned above, according to the invention, the high-strength steel sheets having the dual-phase structure and good strength, ductility, resistance to secondary cold-work embrittlement and spot weldability can be manufactured by using cheap phosphorus and limiting the annealing conditions.

EXAMPLE 1

Each of steel having chemical compositions shown in Table 1 was hot rolled at a hot rolling finish temperature of 830°-870° C. and a coiling temperature of 500°-550° C. and then cold rolled to a thickness of 0.8 mm. Thereafter, this sheet was subjected to three types of annealing, i.e., a box annealing at 670° C. for 10 hours (conventional method), an annealing by gas jet cooling at an average cooling rate of 40°-60° C. between 600° C. and 300° C. after the heating at 770° C. for 60 seconds (invention method), and a water-cooled annealing at a cooling rate of 2,000° C. (comparative method). The tensile properties, spot weldability and resistance to secondary cold-work embrittlement were examined with respect to the thus treated steel sheets. With respect to the spot weldability, the critical current for the occurrence of expulsion was measured by varying a welding current under a welding force of 300 kg and a weld time of 8 Hz, and then the tensile shear test and cross tension test were made by performing the welding at an electric current lower by 500 A than the critical current. With respect to the resistance to second cold-work embrittlement, a cup of 33 mm in diameter was formed at a reduction ratio of 2.06 and its earing was cut out to have a cup height of 26 mm, and then the breakage load was measured by compressing with a punch of frustoconical shape in liquid $N_2$.

FIG. 1 shows the relation between the P content and the annealing condition influencing the resistance to secondary cold-work embrittlement. In this case, the invention method in which P is not more than 0.15% as mentioned above gives an excellent result that the static breakage load is not less than 800 kg in case of the cooling rate of 40°-60° C./sec. FIG. 2 shows the P content and the annealing conditions influencing the spot weldability. In this case, the invention method wherein the continuous annealing is effected at the cooling rate of 40-60° C./sec with the P content not more than 0.15% gives the well balanced and more excellent results on the cross tension test, tensile shear test and ductility ratio as compared with those of the conventional box annealing and the comparative water-cooled annealing. FIG. 3 shows the influences of the P content and the annealing conditions on the relation between tensile strength and elongation. The P content of steels A and E is outside of the range defined in the invention, while the P content of steels B, C, and D is within the range defined in the invention. The steels B, C and D treated at a cooling rate between CR and 200° C./sec are ones obtained by the invention method and have well balanced and more excellent values in the tensile strength and the elongation as compared with those of the other steels A, E. The properties of steel treated at a cooling rate of not more than CR, i.e. ferrite pearlite steel are also shown for the comparison. FIG. 4 shows the relation between the cooling rate and the static breakage load of cup when the cold rolled steel sheet of steel C shown in Table 1 was annealed by largely varying the cooling rate after the heating at 770° C. for 60 seconds. As previously described, the excellent static breakage load of not less than 800 kg is obtained when the cooling rate is within the range of 15°-200° C./sec according to the invention method.

EXAMPLE 2

Steel sheets each having a chemical composition with hot rolling conditions as shown in Table 2 were cold rolled and then continuously annealed under conditions as shown in Table 3. The mechanical tests were made to obtain results as shown in Table 3.

The cooling condition of 2° C./sec in steel No. 2 is outside of the range defined in the invention, and the other steels are within the range of the invention. From Table 3, it is understood that the strength and ductility are more excellent in the steels of the invention.

TABLE 2

| Steel | Chemical composition (wt %) | | | | | | CR | Hot rolling finish temperature | Coiling temperature |
|---|---|---|---|---|---|---|---|---|---|
| No. | C | Si | Mn | P | Al | others | (°C./sec) | (°C.) | (°C.) |
| 1 | 0.07 | 0.03 | 1.8 | 0.08 | 0.03 | — | 2.2 | 840 | 530 |
| 2 | 0.08 | 0.04 | 1.5 | 0.12 | 0.03 | — | 4.3 | 860 | 540 |
| 3 | 0.08 | 0.9 | 1.8 | 0.08 | 0.04 | — | 0.7 | 860 | 580 |
| 4 | 0.07 | 0.03 | 1.7 | 0.06 | 0.04 | B/0.003 | 1.2 | 850 | 520 |
| 5 | 0.07 | 0.03 | 1.9 | 0.08 | 0.03 | Nb/0.04 | 1.5 | 860 | 560 |
| 6 | 0.12 | 1.1 | 2.0 | 0.11 | 0.03 | Nb/0.04 | 0.2 | 860 | 530 |
| 7 | 0.08 | 0.05 | 2.8 | 0.10 | 0.04 | Nb/0.04 | 0.03 | 820 | 510 |

TABLE 3

| Steel | Thickness | Annealing conditions | | Mechanical properties | | | | |
|---|---|---|---|---|---|---|---|---|
| No. | (mm) | Heating conditions | Cooling conditions | Y.S. (kg/mm²) | T.S. (kg/mm²) | Y.R. (%) | El. (%) | Remarks |
| 1 | 1.4 | 770° C. 90 sec | 30° C./sec | 36.2 | 64.8 | 55.9 | 28 | Invention method |
| | | | 8° C./sec at a temperature higher than 550° C. | | | | | |
| | " | " | 30° C./sec at | 31.8 | 62.5 | 50.9 | 30 | Invention method |

TABLE 3-continued

| Steel No. | Thickness (mm) | Annealing conditions: Heating conditions | Annealing conditions: Cooling conditions | Mechanical properties: Y.S. (kg/mm²) | T.S. (kg/mm²) | Y.R. (%) | El. (%) | Remarks |
|---|---|---|---|---|---|---|---|---|
| | | | a temperature not higher than 550° C. | | | | | |
| 2 | 0.7 | 770° C. 60 sec | 30° C./sec | 37.2 | 65.3 | 57.0 | 24 | Invention method |
| | " | " | 2° C./sec | 42.0 | 53.8 | 78.1 | 28 | Comparative method |
| 3 | 1.2 | 830° C. 60 sec | 30° C./sec | 44.3 | 82.1 | 52.4 | 22 | Invention method |
| 4 | " | 770° C. 60 sec | 30° C./sec | 34.9 | 63.3 | 55.1 | 28 | Invention method |
| 5 | " | 800° C. 90 sec | 20° C./sec | 45.2 | 81.5 | 55.5 | 21 | Invention method |
| 6 | 1.0 | 900° C. 60 sec | 50° C./sec | 58.0 | 108.2 | 53.6 | 16 | Invention method |
| | " | 880° C. 60 sec | 100° C./sec | 74.5 | 128.4 | 58.0 | 14 | Invention method |
| 7 | 1.0 | 700° C. 60 sec | 30° C./sec | 72.2 | 127.2 | 56.8 | 15 | Invention method |

INDUSTRIAL APPLICABILITY

As apparent from the above explanation, according to the invention, the low-yield ratio, high-strength steel sheets having not only high strength but also excellent ductility, resistance to secondary cold-work embrittlement, spot weldability and the like can be obtained, and also the production cost is low, so that the invention is suitable for the manufacture of high-strength members for automotive vehicle such as bumper, door guard bar and the like.

We claim:

1. A low-yield ratio, high strength steel sheet having good ductility and resistance to second cold-work embrittlement and a tensile strength of not less than 50 kg/mm², said steel sheet comprising as a weight percentage 0.02–0.15% of C, 0.2–3.5% of Mn (provided that the lower limit is set at 0.8% in case of no addition of Si, Cr, Mo and B), 0.03–0.15% of P and not more than 0.10% of Al as basic components, and optionally containing, as a selective component, at least one element selected from an A-group consisting of 0.1–1.5% of Si, 0.1–1.0% of Cr, 0.1–1.0% of Mo and 5–100 ppm of boron and a B-group consisting of 0.01–0.1% of Nb, 0.01–0.2% of Ti and 0.01–0.2% of V, provided that the amount of the selective components added satisfies the following formula:

$$Mn\% + 0.26Si\% + 3.5P\% + 1.3Cr\% + 2.6\text{-}7Mo\% \geqq 0.64\%$$

and the balance being Fe with inevitable impurities, said steel sheet comprising a dual phase microstructure substantially comprising ferrite and martensite, wherein said steel sheet is obtained by being subjected to an annealing treatment, after cold rolling, comprising the steps of: heating the steel sheet at a temperature of from $Ac_1$ transformation point to 950° C. for from 10 seconds to 10 minutes; and cooling the thus treated sheet under such a condition that an average cooling rate in between 600° C. and 300° C. after the heating is within a range of 15°–200° C./sec.

2. The steel sheet according to claim 1, wherein said steel sheet is obtained by being subjected to an annealing treatment, after cold rolling, comprising the steps of:

heating the steel sheet at a temperature of from $Ac_1$ transformation point to 950° C. for from 10 seconds to 10 minutes; and cooling the thus treated sheet under such a condition that an average cooling rate in between 600° C. and 300° C. after the heating is not less than a critical cooling rate CR(° C./sec) calculated by the following formula (1) and within a range of 15°–200° C./sec:

$$\log CR(^\circ C./sec) = -1.73 + 3.95 \quad (1)$$

provided that the value of 3.95 in the formula (1) is changed into 3.40 in case of addition of B.

3. The steel sheet according to claim 1, wherein the chemical composition of the steel sheet comprises as a weight percentage 0.02–0.15% of C, 0.8–3.5% of Mn, 0.03–0.15% of P, not more than 0.10% of Al and the balance being Fe with inevitable impurities.

4. The steel sheet according to claim 2 including the step of hot rolling before annealing and including the step of coiling after hot rolling and in which the coiling step is a low temperature coiling of not higher than 600° C.

5. The steel sheet according to claim 2 including the step of cooling in the annealing which is carried out by gas jet cooling at an average cooling rate of 40–60 C./sec between 600° C. and 300° C. after the heating.

6. The steel sheet according to claim 2, including the step of slow cooling carried out at a cooling rate of not more than 20° C./sec at a high temperature range of not less than 600° C. after the heating in the annealing.

7. The steel sheet according to claim 1, wherein the static breakage load of cup value is 800 kg or more.

8. The steel sheet according to claim 7, wherein the static breakage load of cup assumes said value when the cup is drawn at a reduction ratio of 2.06.

* * * * *